US005375406A

United States Patent [19]

Görlich et al.

[11] Patent Number: 5,375,406

[45] Date of Patent: Dec. 27, 1994

[54] PROCESS AND ARRANGEMENT FOR SPINNING OF YARN FROM FIBER MATERIAL HAVING AN ADJUSTABLE CLIMATE-CONTROLLED ZONE FOR THE WORKING ELEMENTS

[75] Inventors: Roland Görlich, Donzdorf; Kurt Lang, Lauterstein, both of Germany

[73] Assignees: Fritz Stahlecker; Hans Stahlecker, both of Germany

[21] Appl. No.: 125,218

[22] Filed: Sep. 23, 1993

[30] Foreign Application Priority Data

Sep. 23, 1992 [DE] Germany ..... 4231728

[51] Int. Cl.[5] ..... D01H 13/26; D01H 13/28

[52] U.S. Cl. ..... 57/308; 57/264; 57/315; 57/352

[58] Field of Search ..... 57/308, 264, 315, 90, 57/352, 1 R; 236/44 R, 44 A; 62/176.1

[56] References Cited

U.S. PATENT DOCUMENTS

| | | | |
|---|---|---|---|
| 3,391,528 | 7/1968 | Shackelford | 57/308 X |
| 3,564,829 | 2/1971 | Tsuzuki | 57/308 |
| 4,022,007 | 5/1977 | Motobayashi et al. | 57/308 X |
| 4,350,007 | 9/1982 | Gasser et al. | 57/308 X |
| 4,966,017 | 10/1990 | Chern | 57/308 X |
| 5,157,910 | 10/1992 | Artzt et al. | 57/308 |
| 5,170,615 | 12/1992 | Strahlen et al. | 57/308 |
| 5,259,181 | 11/1993 | Stahlecker et al. | 57/308 |
| 5,261,220 | 11/1993 | Stahlecker | 57/308 |
| 5,287,693 | 2/1994 | Stahlecker | 57/308 |

FOREIGN PATENT DOCUMENTS

| | | | |
|---|---|---|---|
| 3919284A1 | 12/1990 | Germany . | |
| 4100618A1 | 7/1992 | Germany . | |
| 4109110A1 | 9/1992 | Germany . | |
| 4123451 | 1/1993 | Germany | 57/308 |
| 1183208 | 3/1970 | United Kingdom . | |

*Primary Examiner*—Daniel P. Stodola
*Assistant Examiner*—William Stryjewski
*Attorney, Agent, or Firm*—Evenson, McKeown Edwards & Lenahan

[57] ABSTRACT

A spinning arrangement in which the working elements for the processing of fiber material are arranged within an adjustable climate-controlled zone. The climate-controlled zone can be adjusted in such a manner that the fiber material fed to the working elements has the tendency to supply humidity to the ambient air of the climate-controlled zone. Before the feeding, particularly when deposited in a can or on a roving bobbin and/or on the transport path to the working elements, the fiber material is surrounded by air whose climate differs from the climate in the adjustable climate-controlled zone of the working elements. During the processing, the fed fiber material and the working elements are each in a different climatic condition that is optimal for the processing.

20 Claims, 2 Drawing Sheets

PROCESS AND ARRANGEMENT FOR SPINNING OF YARN FROM FIBER MATERIAL HAVING AN ADJUSTABLE CLIMATE-CONTROLLED ZONE FOR THE WORKING ELEMENTS

BACKGROUND AND SUMMARY OF THE INVENTION

This invention relates to a process for the spinning of yarn from fiber material which, in the case of an arrangement for spinning, is transported from a supply of fiber material to the working elements of said arrangement for spinning, with at least some of said working elements being arranged within a climate-controlled zone which contains a fluid whose climate can be adjusted. The invention also relates to an arrangement for the spinning of yarn from fiber material, comprising a device for making a supply of fiber material available, and comprising working elements for the processing of the fiber material which is removed from the device for making the fiber material available. While travelling along a transport path, the fiber material is supplied to the working elements, at least some of which are arranged within a climate-controlled zone which contains a fluid whose climate is adjustable.

Conventionally, in practice, the climate of the working elements of spinning arrangements which process the supplied fiber material is controlled in that the whole spinning machine containing the spinning arrangements, including the fiber supply, are subjected to a uniform climate existing in the spinning room. This type of climate control is known from German Patent Document DE 41 00 618A1. For generating uniform climatic conditions, it is suggested there to construct the platform which is arranged above the machine frame and the working elements of the spinning arrangements and on which the cans with the sliver are deposited, in a permeable manner in order to permit a free circulation of the conditioned air. As a result, a uniform climate is obtained for the sliver and the working elements carrying out the spiraling. In this case, the fed sliver supplies no humidity to the ambient air during the processing. The uniform climate permits an essentially perfect functioning of the working elements and an essentially proper capacity to be processed of the fiber material.

In the published German patent application with the reference number DE 41 09 110 A1, a spinning machine is described in which cans containing sliver are deposited on a platform arranged vertically above the machine frame and the working elements of the spinning arrangements. For the purpose of climate control, air inlet and air outlet ducts are provided which are arranged such that conditioned fluid flows penetrate the drafting units in the vertical direction and form climate-controlled zones in this manner which fill only a portion of the spinning room. As a result, a low energy consumption is achieved because the whole spinning room does not have to be climate-controlled.

From published German patent application DE 39 19 284 A1, it is known to control the climate of only the spinning material which is deposited in a container, in which case the working elements of the spinning machine are at any room climate. As a result, the spinning material is to be put into an optimal climatic condition in order to improve the quality of the product to be produced.

From British Patent Document GB-PS 11 83 208, it is known to supply the fiber material from cans, which are arranged on platforms above the spinning machine, to the spinning arrangements through tubes. In this case, the fed slivers are subjected to an air flow with a certain humidity content on the transport path in the tubes in order to control the humidity content of the slivers.

It is an object of the invention to produce optimal climatic conditions for the operation of the working elements of spinning arrangements as well as for the processing capacity of the supplied fiber material.

This and other objects are achieved by the present invention which provides a process for the spinning of yarn from fiber material in an arrangement for spinning, the method comprising transporting the fiber material from a supply of fiber material to working elements of the arrangement for spinning, with at least some of the working elements being arranged within a climate-controlled zone which contains a fluid whose climate is adjustable, and adjusting the climate such that at least one of the fiber material and yarn spun from the fiber material have a tendency to supply humidity to the fluid of the climate-controlled zone.

The objects are also achieved by an embodiment of the present invention which provides an arrangement for spinning yarn from fiber material, comprising a device for making available a supply of fiber material, a climate-controlled zone containing a fluid with an adjustable climate, and working elements for processing of the fiber material, with at least some of the working elements being within the climate-controlled zone. A transport path is provided between the device for making available and the working elements, the fiber material being removed from the device for making available and supplied to the working elements while travelling through the transport path. A climate is produceable in the climate-controlled zone which differs from a climate of the fluid which surrounds the fiber material in at least one of the device for making the fiber material available and on the transport path to the working elements.

In certain embodiments of the invention, the fluid is air or another suitable gas.

The present invention provides the advantage of optimizing the processing capacity of the fiber material and therefore the quality of the end product as well as optimizing the functioning of the working elements used for spinning.

The invention is based on the recognition that the working elements operate optimally, that is largely faultlessly, under certain climatic conditions and that the fiber material to be processed under certain climatic conditions can be processed to an optimal degree. In this case, the optimal climatic conditions differ with respect to the operation of the working elements and with respect to the processing capacity of the fiber material.

If optimal climatic conditions were to be provided for the fiber material to be processed and the working elements were to be subjected to the same climatic conditions, so that no humidity is supplied by the fiber material to the fluid surrounding the working elements, disturbances may occur in the operation of the working elements. For example, when the humidity of the fluid surrounding the working element is too high, individual fibers may wind around the drafting unit top rollers.

If optimal climatic conditions were provided for the working elements and the fiber material to be processed were to be subjected to the mentioned climatic conditions as the working elements, the humidity content of the fiber material may be too low for a good processing. When the humidity content is too low, the processing capacity of the fiber material and the quality of the end product will deteriorate.

With the known uniform climate control for the supplied fiber material and the working elements, non-optimal but acceptable climatic conditions are achieved with respect to the processing capacity of the fiber material as well as the running characteristics of the working elements. With the known climate control of only the fiber material, optimal conditions are endeavored with respect to the processing capacity but not with respect to the operation of the working elements. In contrast, with the climate control of the present invention, optimal climatic conditions are created with respect to the operation of the working elements as well as with respect to the processing capacity of the fiber material.

For optimum functioning of the working elements, particularly of the drafting unit rollers of a drafting unit, it is required that the fluid surrounding the working elements does not have an excessive relative humidity. In contrast, the humidity content of the fiber material must be relatively high for an optimal processing capacity. The humidity content should be at least so high that the fed fiber material, when it enters the climate-controlled zone that includes the working elements, will have the tendency to supply the humidity to the fluid of the climate-controlled zone. It is important in this case that at least the climate-controlled zone surrounding the working elements can be adjusted relatively precisely with respect to its climate, whereas the humidity content of the fed fiber material does not necessarily have to be adjusted precisely.

The climate-controlled zone surrounding the working elements is expediently produced by the present invention in that a fluid is supplied whose temperature and/or relative humidity can be adjusted. In this manner, a precise adjustability of the climate within the climate-controlled zone can be achieved.

In certain embodiments of the invention, it is provided that a fluid is supplied to the fiber material at the supply of fiber material and/or during the transport to the working elements, the temperature and/or relative humidity of the fluid being adjustable. In this case, it is not absolutely necessary that the fluid is supplied during the whole transport; on the contrary, the supplying of the conditioned fluid in a partial area of the transport path may also be sufficient so that a satisfactory effect is achieved. Naturally, it is also possible to supply the conditioned fluid only to the supply of fiber material or only to the transport path or to a part of it. As a result of this measure, it is possible to influence the humidity content of the fed fiber material.

In these embodiments, the adjustment advantageously takes place in that the temperature and/or the relative humidity of the fluid surrounding the fiber material differs from the temperature and/or the relative humidity of the fluid in the climate-controlled zone. In this case, it may be advantageous to select for the fluid surrounding the fiber material a high relative humidity and to select for the fluid surrounding the working elements a low relative humidity. The fiber material may then absorb humidity at the deposited supply or during the transport to the working elements so that it has the tendency to supply humidity at the working elements.

In an advantageous embodiment of file present invention, it is provided that only fluid is supplied to the climate-controlled zone which had previously been fed to the fiber material at the supply of fiber material and/or during the transport to the working elements, in which case the supplied fluid is heated at the climate-controlled zone of the working elements. Because of the heating, the relative humidity of the fluid will fall in the climate-controlled zone so that the fiber material which previously has absorbed humidity from the fed fluid, has the tendency to supply humidity in the climate-controlled zone.

In this embodiment, it is advantageous for the climate of the fed fluid to be adjusted as a function of the heating occurring in the climate-controlled zone. While the occurring heating is taken into account, the fluid will then have the desired relative humidity in the climate-controlled zone. As a result, it is possible to adjust the climate in the climate-controlled zone very precisely so that optimal conditions are obtained with respect to the operability of the working elements. In the case of the climatic conditions of the fluid surrounding the supply of the fiber material and/or the transport path of the fiber material, a certain bandwidth could definitely be accepted without leaving the range of the optimal climatic condition for the capacity to be processed of the fiber material. In addition, it should be possible in this embodiment, also for a precisely determined and constant temperature and/or relative humidity in the area of the climate-controlled zone of the working elements, to obtain by means of the corresponding adjustment of the climate of the supplied fluid a precisely predeterminable value in the case of the climate of the fluid surrounding the fiber material at the supply and/or during the transport.

In this embodiment, it is advantageous to measure the temperature and/or the relative humidity in the climate-controlled zone and adjust, according to the measured value, the temperature and/or the humidity of the supplied fluid.

It is also advantageous for the fluid supplied to the climate-controlled zone to be heated only by the waste heat produced by the working elements during the spinning operation. The supplied fluid will then be adjusted corresponding to the produced waste heat and to the resulting heating of the climate-controlled zone with respect to its temperature and/or its humidity. The temperature and/or relative humidity which exists in the working elements during the operation of the spinning machine may be measured. Also, the heating occurring at the working elements as a result of the operation can be calculated at least approximately. It can therefore be determined for the adjusting of the climate-controlled zone to what extent, in the case of a measured or calculated temperature difference, the relative humidity of the fluid in the climate-controlled zone will change with respect to the relative humidity of the fluid in the area of the supply of the fiber material and/or the transport of the fiber material.

For achieving the desired climatic conditions, in the case of an arrangement for the spinning of yam, a climate-controlled zone is provided in the case of the working elements which is adjustable with respect to its climate and in which a climate can be produced which differs from the climate of the fluid which surrounds the fiber material at the device for making the supply of the fiber material available and/or on the transport path of the fiber material to the working elements. As mentioned above, it is not absolutely necessary in this case that the whole transport path is surrounded by a fluid whose climate differs from the climate of the climate-controlled zone surrounding the working elements.

It is advantageous in this case for the climate to be adjustable in such a manner that the fluid in the climate-controlled zone has a lower relative humidity than the fluid which surrounds the fiber material at the device for making it available and/or on the transport path to the working elements.

It is also advantageous to arrange the climate-controlled zone in such a manner that, of the working elements of a spinning arrangement, at least the drafting unit and/or the ring spindle are situated within the climate-controlled zone, in which case the fiber material deposited as sliver in a can is situated outside the climate-controlled zone. Particularly in the case of drafting devices, considerable running disturbances may occur when the air-conditioning is not appropriate. Also, in the case of the above-mentioned arrangements, an air-conditioning of the drafting unit and/or of the ring spindle is particularly advantageous because a clear separation can be achieved between the area of the/bed of the sliver and the processing of the sliver.

In certain embodiments of the invention, the mentioned deviation of the climate in the climate-controlled zone can be achieved in that a partition is provided which separates the area of the working elements from the area of the fiber material feed and the transport path, in the case of which the two areas are connected with one another by a passage opening for the fiber material.

In certain embodiments of the invention, the machine frame which carries the working elements is arranged on the same side of the partition as the climate-controlled zone.

Expediently, a common climate-controlled zone is arranged in the spinning machine for the working elements of all arrangements for the spinning.

In an advantageous embodiment of the invention, it is provided to arrange, in a spinning machine, the devices for making the fiber material available on a platform which is arranged vertically above the machine frame of the spinning machine. In this case, it is advantageous to provide the partition at the platform. As a result of this measure, an effective separation can be achieved of the areas with the different climates.

In another embodiment of the present invention, in the case of a spinning machine, the devices for making a supply of fiber material available are arranged on surfaces which are situated opposite one or both longitudinal sides of the spinning machine. In the case of a one-sided spinning machine, the surfaces are arranged on the rear side of the spinning machine. In the case of a two-sided spinning machine, the surfaces are arranged in parallel to both operating sides of the spinning machine, and an operating aisle is provided between the surfaces and the spinning machine.

In certain embodiments, the relative humidity and/or the temperature of the fluid of the climate-controlled zone are adjustable. In certain embodiments, the climate in the climate-controlled zone is produced by a fluid flow which is supplied by a feeding duct and is discharged by a discharge duct.

In an advantageous embodiment of the present invention, the feeding duct is arranged on the side of the partition which has the device for making the supply of fiber material available and/or the transport path, and the discharge duct is arranged on the side of the partition which has the working elements, in which case the partition has a passage opening for the fluid flow which extends to the working elements. In this embodiment, a separate adjustment is not possible of the fluid contained in the climate-controlled zone on the side of the working elements, on the one hand, and of the fluid surrounding the fiber material on the side of the device for making the fiber material available and/or of the transport path, on the other hand. On the contrary, only the climate in the climate-controlled zone on the side of the working element is adjusted. The adjustment of the climate on the side of the feed of the fiber material and/or of the transport path therefore depends only on the temperature and/or the relative humidity which is desired in the climate-controlled zone. For this embodiment, it is taken into account that the fluid supplied through the feeding duct supplies humidity to the fiber material, if this fiber material can still absorb humidity, and that the supplied fluid is heated at the climate-controlled zone by the working elements of the spinning arrangements and possibly, by additional rotating machine elements.

It is advantageous in this embodiment to arrange a sensor at the climate-controlled zone of the working elements which can measure the climate of the fluid with respect to its temperature and/or its relative humidity. The sensor is connected with a device by means of which the climate of the fluid can be adjusted, which fluid is supplied through the feeding duct onto the side of the partition which has the device for making the fiber material available, and/or the transport path. With respect to its climate, the fed fluid is adjusted corresponding to the temperature measured in the climate-controlled zone and/or the relative humidity. In the case of the adjustment of the climate of the supplied fluid, the heating occurring in the climate-controlled zone is taken into account.

The device for making the supply of the fiber material available and/or the transport path are therefore situated within a second climate-controlled zone which is formed by the fluid supplied through the feeding duct. This second climate-controlled zone cannot be adjusted separately: however, the climate in this second climate-controlled zone is a function of the adjustment of the climate in the first climate-controlled zone which contains the working elements. A precise adjustment of the climate in the second climate-controlled zone is also not absolutely necessary, for achieving good spinning results. The relative humidity in the second climate-controlled zone is higher than in the first climate-controlled zone because the relative humidity of the fluid falls because of the heating.

Other objects, advantages and novel features of the present invention will become apparent from the following detailed description of the invention when considered in conjunction with the accompanying drawings.

DETAILED DESCRIPTION OF THE DRAWINGS

Figure 1:
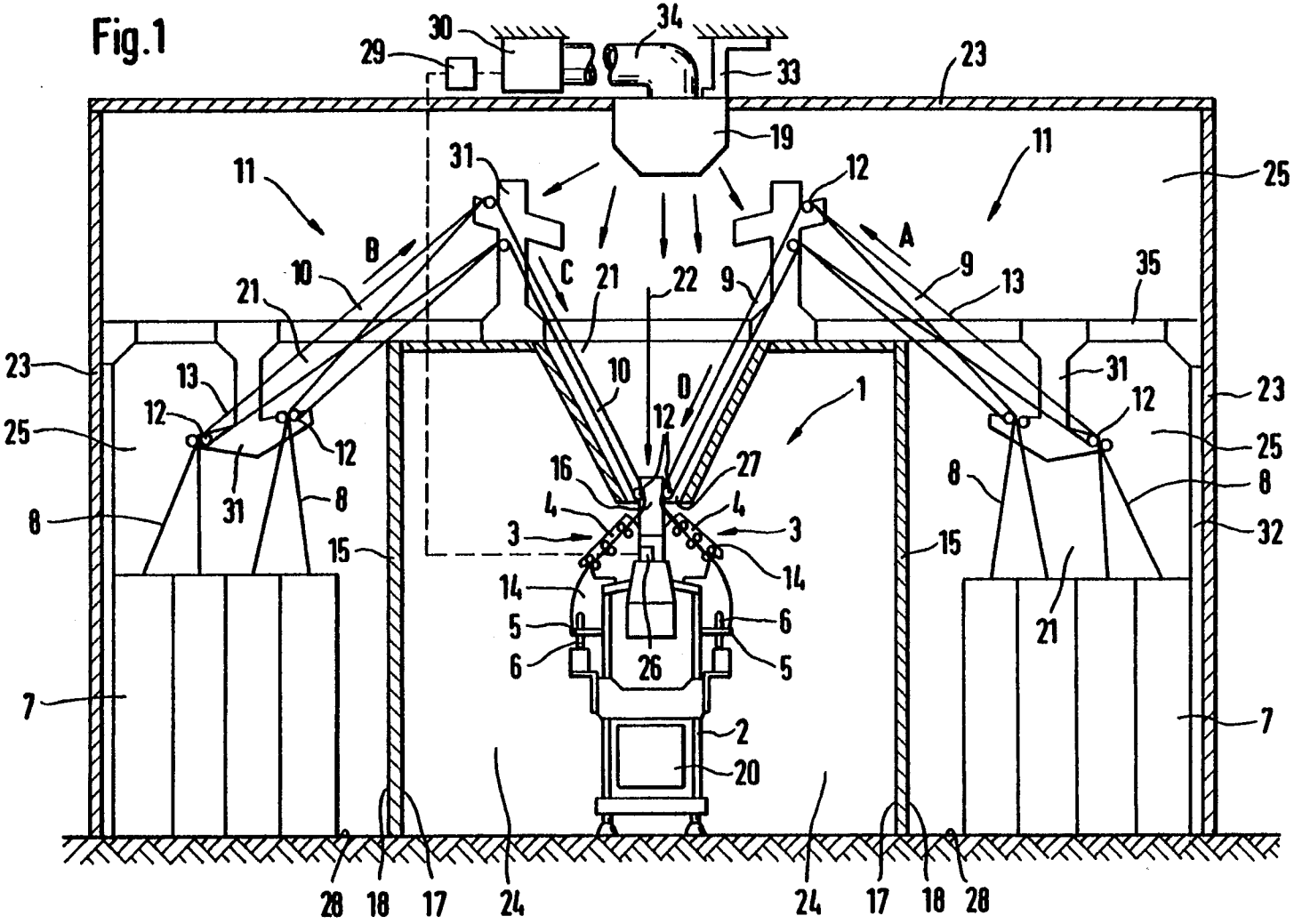
FIG. 1 is a cross-sectional view of a two-sided ring spinning machine constructed in accordance with an embodiment of the present invention, in which a feeding duct is arranged on the side of the sliver feed, and a discharge duct is arranged on the side of the working elements.

The two-sided ring spinning machine illustrated in FIG. 1 comprises a plurality of spinning arrangements 3 which are arranged next to one another on both longitudinal sides of the ring spinning machine 1. A supply of sliver 8 which is deposited in cans 7 is assigned to each spinning arrangement 3. For each spinning arrangement 3, the sliver 8 is supplied to the working elements 4, 5, 6 of the spinning arrangement 3 and is spun there into a yarn. FIG. 1 only shows the drafting unit 4, the spinning ring 5 and the ring spindle 6 of the working elements of each spinning arrangement. The working elements 4, 5, 6 of all spinning arrangements 3 of the ring spinning machine 1 are mounted on the machine frame 2 of the ring spinning machine 1.

The cans 7 are deposited on surfaces 28 which are provided in parallel to the longitudinal sides of the ring spinning machine 1 while leaving a respective operating aisle. The slivers 8 are fed from the cans 7 by the transport devices 11 to the assigned working elements 4, 5, 6 of each spinning arrangement 3. The transport devices 11 contain driven transport belts 13 which are guided around deflecting rollers 12 which, in turn, are rotatably fastened on holding devices 31.

Along the operating aisles, a partition 15 is arranged on each longitudinal side of the machine. The partitions 15 begin at the surfaces 28 and first extend vertically upwards and after a short horizontal course, are angled diagonally downward in the direction of the machine center, and end slightly above the inlet sides of the drafting units 4. By means of the partitions 15, two spaces 24 and 25 are formed which are separated from one another. Space 24 contains the machine frame 2 and the working elements 4, 5, 6 of the spinning arrangements 3 fastened to it. Space 25 contains the cans 7 with a supply of sliver 8 and the transport devices 11. The transport device 11, which is shown on the right-hand side of FIG. 1, transports the slivers 8, which are removed from the cans 7 and placed on the transport belts 13, first into the direction of the arrow A and then into the direction of the arrow D to the drafting units 4. The transport path that was travelled in this case in the direction of the arrow A and in the direction of the arrow D has the reference number 9. Correspondingly, the slivers 8 illustrated on the left-hand side of FIG. 1 are first transported in the direction of the arrow B and then in the direction of the arrow C to the drafting units 4, in which case the transport path 10 is travelled in the direction of the arrow B as well as in the direction of the arrow C. In the embodiment illustrated in FIG. 1, the transport path 9, 10 which is travelled by the sliver 8 from the can 7 to the assigned drafting unit in the case of every spinning arrangement 1, is situated completely inside the space 25, thus on the side 18 of the partition 15 on which the surfaces 28 for the cans 7 with the supply of sliver 8 are situated. On its transport path 9, 10, the sliver 8 travels through a passage opening 16 which is arranged at the point at which the partitions 15 of each side of the machine converge above the drafting units 4. The passage opening 16 for the sliver 8 has a relatively large width so that, at the same time, it forms the passage opening 27 for a fluid flow 22 transported from space 25 to space 24.

At some distance from the partitions 15, additional walls 23 are arranged in such a manner on the side 18 containing the cans 7 that an enclosed space 25 is formed in which the cans 7 of the spinning arrangements 3 of both longitudinal sides of the ring spinning machine 1 as well as the transport devices 1 I are housed. Correspondingly, on side 17 of the partitions 15, an enclosed space 24 is formed in which the machine frames 2 and the working elements 4, 5, 6 of the spinning arrangements 3 fastened to them are housed.

At the upper interior wall of space 25, a feeding duct 19 is arranged which extends in the longitudinal direction of the ring spinning machine 1, is fastened by holding devices 33 and is provided with outlet openings for a conditioned fluid. In the illustrated embodiment, air is used as the fluid. By way of a tube 34, the feeding duct 19 is connected to a device 30 by means of which the climate, that is, the temperature and the humidity content of the fed air, is produced. This device 30 may, for example, contain a humidifier, which is not shown in the drawing, as well as a refrigerating/heating unit. The device 30 for producing the climate of the fed air is connected with an adjusting device 29 by means of which the temperature and/or the humidity content or the relative humidity of the air can be determined. The adjusting device 29 may, in addition, be connected with a flap valve arranged at the tube 34 and/or the device 30.

In space 24, a discharge duct 20 is arranged which is provided with inlet openings and which extends in the longitudinal direction in the area vertically downward of the ring spinning machine 1. The discharge duct 20 has the purpose of discharging air supplied through the feeding duct 19.

In space 24, several sensors 26 are arranged which are used for measuring the heat and/or the relative humidity of the air in the area of the working elements 4, 5, 6. The sensors 26 are connected in such a manner with the adjusting device 29 for the adjusting of the climate of the air which is fed through the feeding duct 19 that signals corresponding to the measured temperature and/or the relative humidity are sent to the adjusting device 29 which cause the adding of heat, refrigeration and/or humidity to the air in the device 30 for the producing of conditioned air.

The conditioned air fed through the feeding duct 19 reaches, through the outlet openings which are not shown, the space 25 and penetrates the sliver 8 there on the transport path 9, 10. The conditioned air arrives, at least partially, also in the cans 7 and penetrates the sliver 8 deposited there. At the cans 7 and on the transport path 9, 10, climate-controlled zones 21 are produced which may possibly fill the whole space 25. When the effect is sufficiently long, the sliver 8 absorbs humidity from the air until a balanced climatic condition exists between the fed air and the sliver 8. Naturally, it would be possible, if the sliver 8 were to contain a lot of humidity, to supply humidity to the fed air. The air fed through the feeding duct 19 reaches, in the form of an air flow 22 directed vertically downward, through the passage opening 27 into the space 24 in which the machine frame 2 and the working elements 4. 5, 6 are situated. The air supplied into space 24 heats up, whereby the relative humidity of the air flow 22 will fall. The relative humidity of the air in space 24 is therefore lower than in space 25. The heating in space 24 occurs because of the waste heat generated by the working elements 4, 5, 6 and other rotating parts arranged at the machine frame 2.

By means of the heating of the air flow 22, a climate-controlled zone is created at least in the area of the working elements 4, 5, 6. Naturally, the climate-controlled zone 14 does not have to be limited to the area of the working elements 4, 5, 6; it may, on the contrary, also take up the whole space 24. However, it is sufficient for the climate-controlled zone of the working elements 4, 5, 6 to comprise at least the drafting unit 4.

As a function of the measurement of the sensors 26, the climate is adjusted by the air supplied through the feeding duct 19. In this case, the temperature of the air fed through the feeding duct 19 will as a rule be below the temperature measured in the climate-controlled zone because during the adjustment the heating of the air must be taken into account which occurs in the area of the working elements 4, 5, 6. Because of the lower temperature, the air in space 25 has a higher relative humidity than the air in space 24. As a function of the relative humidity desired in space 24 or in the climate-controlled zone 14, the temperature and the relative humidity of the air which is fed through the feeding duct 19 is adjusted. The climate-controlled zone 21 which forms in space 25, in the case of the embodiment illustrated in FIG. 1, cannot be adjusted separately because the adjustment of the climate takes place only according to the temperature and/or relative humidity of the air desired in the climate-controlled zone 14 of the working elements 4, 5, 6. However, the climate-controlled zone 21 which is created in space 25 as the result of the adjustment of the climate in climate-controlled zone 14 can be predetermined at least approximately and can also be influenced by the corresponding adjustment of the climate-controlled zone 14. For an optimal climate in the climate-controlled zone 21, it is not necessary to maintain precise values in the case of the temperature and/or the relative humidity of the air. Instead, for an optimal climate of the climate-controlled zone 21 comprising the fiber feed, it is sufficient to maintain the temperature and/or the relative air humidity within a certain range. However, in the case of a good (non-optimal) adjustment of the climate in the climate-controlled zone 14, it is definitely possible to obtain precisely predeterminable optimal climate conditions in the climate-controlled zone 21, although there the maintaining of precise values is not absolutely necessary.

Optimal climate conditions in the area of the working elements as well as in the area of the sliver feed have been obtained when pure cotton was used as the fiber material, if the climate-controlled zone 14 in the case of the working elements was adjusted to a relative air humidity of from 50 to 55%. As a function of this relative air humidity desired in the climate-controlled zone 14, a climate with a relative air humidity of from 70 to 75% was obtained in the climate-controlled zone 21 of the sliver feed.

Figure 2:
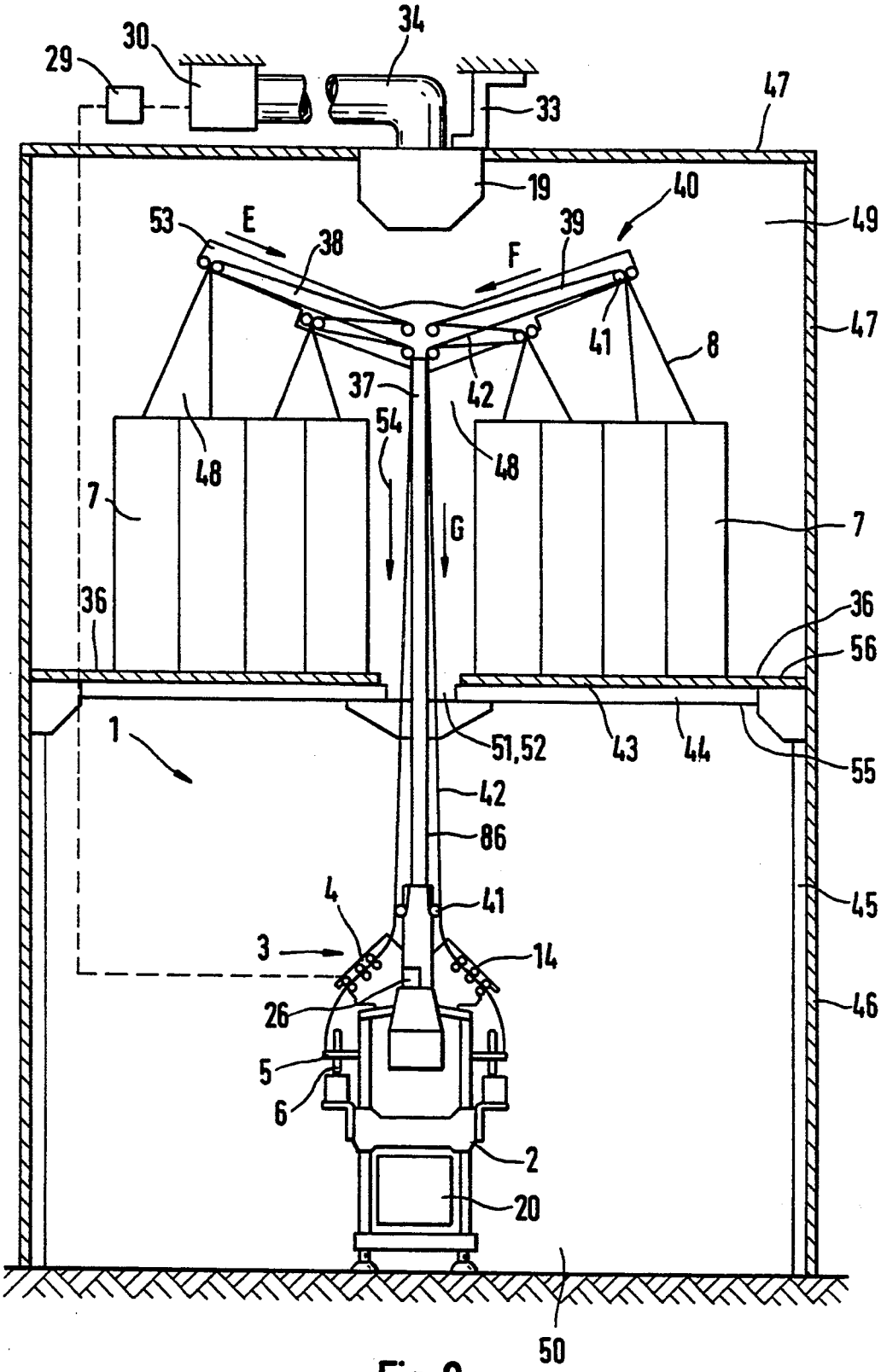
FIG. 2 is a view of a ring spinning machine with an arrangement of the feeding duct and of the discharge duct corresponding to FIG. 1, but in which silver cans are arranged on a platform.

The embodiment illustrated in FIG. 2 differs from the embodiment according to FIG. 1, among others, by the fact that in this case, the cans 7 are deposited on a platform 44 which is arranged vertically above the machine frame 2 of the ring spinning machine 1. The sliver 8 taken out of the cans 7, by means of the transport belts 42, which are guided via deflecting rollers 41 arranged on the holding devices 53, is first guided in an essentially horizontal direction of the arrows 1,2 and F and then in the vertical direction (arrow G) to the drafting units 4. In the case of the transport in the direction of arrows E and F, transport paths 38 and 39 are travelled and, in the case of the transport in the direction of the arrow G, transport paths 37 and 86 are travelled.

For the platform 44, a partition 43 is arranged which is provided with a passage opening 51 for the sliver 8 which is expanded to a passage opening 52 for the air flow 54. The partition 43 is adjoined on both sides by additional walls 46, 47 so that on side 55 a space 50 is formed which accommodates the working elements 4, 5, 6 and the machine frame 2 of the ring spinning machine 1, and on side 56, a space 49 is formed which encloses the cans 7 and the transport path 37, 38, 39 of the sliver 8.

In contrast to the embodiment described in FIG. 1, a relatively small portion of the course of the transport path 86 which, during the transport of the sliver 8, extends in the vertical direction G is situated in space 50 in which the working elements 4, 5, 6 of the spinning arrangements 3 are also arranged.

In the same manner as described in the embodiment of FIG. 1, the climate is adjusted in the climate-controlled zone 14 comprising the working elements 4, 5, 6, in which case the air fed through the feeding duct 19 is adjusted as a function of the value desired in the climate-controlled zone 14. The climate-controlled zones 48 are formed in space 49 which comprise the transport path 37, 38, 39 of the sliver 8 and/or the cans with the sliver 8 which are deposited on the surfaces 36, or fill the whole space 49. The air flow 54 guided from the space 49 through the passage opening 52 into the space 50 heats up in the area of the working elements 4, 5, 6 because of the waste heat generated there during operation. The relative air humidity of the air flow 54 therefore falls in the area of the climate-controlled zone 14 to the desired value which was previously adjusted as a function of the heating to be expected. In the climate-controlled zone, a relative air humidity is formed which, as a function of the value adjusted for the climate-controlled zone 14, is higher than the relative air humidity in the climate-controlled zone 14.

The embodiments described with respect to FIGS. 1 and 2 have in common that two climate-controlled zones 14 and 21 as well as 14 and 48 respectively are formed, in which case the climate-controlled zones 21 and 48 of space 25 and 49 which accommodate the cans 7 and the transport path 9, 10 and 37, 38, 39 cannot be adjusted separately but, on the contrary, form as a function of the climate adjusted in the climate-controlled zone 14. Since, in the case of the adjustment of the climate-controlled zone 14, the waste heat occurring in the case of the working elements 4, 5, 6 reduces the relative air humidity in this climate-controlled zone 14, which is taken into account when the climate-controlled zone 14 is adjusted, the relative air humidity in the climate-controlled zones 21 and 48 of the spaces 25 and 49 is higher than the relative air humidity in the climate-controlled zones 14.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An arrangement for spinning yarn from fiber material, comprising:

means for supplying the fiber material;

means for humidifying the fiber material in a climate of a relatively high humidity;

a climate-controlled zone with an adjustable climate;

working elements for processing the fiber material, at least some of the working elements being within the climate-controlled zone;

means for transporting the fiber material between the means for supplying and the working elements in the climate-controlled zone; and means for adjusting the climate in the climate-controlled zone to a lower relative humidity than the climate for humidifying the fiber material by controlling the humidifying means.

2. An arrangement according to claim 1, wherein the working elements include a drafting unit for the drafting of the fiber material fed from a can in the form of a sliver, and further includes a ring spindle, wherein at least one of the drafting unit and the ring spindle are within the climate-controlled zone.

3. An arrangement according to claim 2, further comprising a partition that separates the climate-controlled zone from the means for supplying the fiber material available and from the transport path, said partition having a passage opening for feeding the fiber material to the working elements.

4. An arrangement according to claim 3, further comprising a machine frame, with a plurality of said arrangements for spinning yarn arranged on a spinning machine that includes said machine frame, the machine frame carrying the working elements of the arrangements for the spinning, wherein the machine frame of the spinning machine is on a same side of the partition as the climate-controlled zone.

5. An arrangement according to claim 4, wherein the climate-controlled zone is common for the working elements of all arrangements for the spinning of yarn of the spinning machine.

6. An arrangement according to claim 5, further comprising a platform which is vertically above the machine frame of the spinning machine, wherein the means for supplying the fiber material are on said platform.

7. An arrangement according to claim 6 wherein the partition is arranged at the platform.

8. An arrangement according to claim 5, further comprising surfaces which are situated opposite at least one of the longitudinal sides of the spinning machine, wherein the means for supplying the fiber material are on said surfaces.

9. An arrangement according to claim 8, wherein at least one of the relative humidity and the temperature of the fluid of the climate-controlled zone is adjustable.

10. An arrangement according to claim 9, wherein the climate in the climate-controlled zone is produced by a fluid flow which is fed through a feeding duct and is discharged through a discharge duct.

11. An arrangement according to claim 10, wherein the feeding duct is arranged on the side of the partition comprising at least one of the means for supplying the fiber material and the transport path, and the discharge duct is arranged on the side of the partition comprising the working elements, said partition having a passage opening for the fluid flow extending to the working elements.

12. An arrangement according to claim 11, further comprising a sensor connected with a device for adjusting the climate of the fluid which is fed through the feeding duct to the side of the partition which comprises at least one of the means for supplying the fiber material and the transport path, said sensor measuring the climate of the fluid in the climate-controlled zone.

13. An arrangement according to claim 12, wherein at least one of the means for supplying the fiber material and the transport path of fiber material to the working elements of the arrangement for spinning are arranged at least partially within a second climate-controlled zone which is adjustable as a function of the climate-controlled zone comprising the working elements.

14. An arrangement according to claim 13, wherein the discharge duct is vertically below the working elements of the arrangements for spinning.

15. A process for spinning of yarn from fiber material in an arrangement for spinning, comprising:

arranging at least some working elements of the arrangement for spinning in a climate-controlled zone in which at least one of humidity and temperature are adjustable;

transporting the fiber material from a supply of fiber material to the working elements of said arrangement for spinning;

humidifying the fiber material in a climate having a relatively high relative humidity before the fiber material arrives at the working elements in the climate-controlled zone; and adjusting the climate in the climate-controlled zone to be at a lower relative humidity compared with the climate for humidifying the fiber material by controlling the humidity of the relatively high humidity climate.

16. A process according to claim 15, further comprising humidifying the fiber material in a climate of relative humidity of greater than or equal to approximately 70% and adjusting the climate in the climate-controlled zone to be at a relative humidity of equal to or less than approximately 55%.

17. A process according to claim 15, further comprising humidifying the fiber material at least one of at the supply of fiber material and during the transport of fiber material to the working elements by exposing the fiber material to a climate having at least one of the temperature and the relative humidity being adjustable.

18. A process according to claim 15, further comprising supplying to the climate-controlled zone and to the fiber material at least one of the supply of fiber material and during the transport to the working elements a gaseous fluid originating from a common source and having the same temperature and the same humidity and generating in the climate-controlled zone a temperature above the temperature of the supplied gaseous fluid.

19. A process according to claim 18, further comprising adjusting at least one of the temperature and the humidity of the gaseous fluid supplied to the fiber material and to the climate-controlled zone as a function of the temperature and the humidity generated in the climate-controlled zone.

20. A process according to claim 19, further comprising heating the climate-controlled zone by heat generated by the working elements during the spinning operation.

* * * * *